US006347670B1

(12) United States Patent
Miskin

(10) Patent No.: US 6,347,670 B1
(45) Date of Patent: Feb. 19, 2002

(54) EARTH MOVING SCRAPER

(76) Inventor: Richard B. Miskin, 4966 Marbrissa La., Idaho Falls, ID (US) 83406

( * ) Notice: Subject to any disclaimer, the term of this patent is extended or adjusted under 35 U.S.C. 154(b) by 0 days.

(21) Appl. No.: 09/527,176

(22) Filed: Mar. 17, 2000

(51) Int. Cl.[7] ..... E02F 5/00

(52) U.S. Cl. ..... 172/199; 172/684.5; 37/381; 37/417; 37/418; 37/419; 37/425; 37/426; 37/428

(58) Field of Search ..... 37/381, 411, 416, 37/417, 418, 419, 424, 425, 426, 427, 428; 172/610, 684.5, 197, 199

(56) References Cited

U.S. PATENT DOCUMENTS 4,388,769 A 6/1983 Miskin ..... 37/126

OTHER PUBLICATIONS

Reynolds Brochure Model 17C 17 YD3 Carry–All Scraper, Date Unknown.

Cameco Industries Brochure 12C Carry–All Scraper, Jan. 1998.

*Primary Examiner*—Christopher J. Novosad
(74) *Attorney, Agent, or Firm*—Pettis & Van Royen, P.A.

(57) ABSTRACT

An apparatus for modifying the earth's surface by removing soil from the surface, moving the soil to a new location and filling low areas. It comprises a frame carried by at least two wheels, a tongue mounted to the frame for attachment to a tractor, a cutting blade mounted on the frame, and a bucket pivotally mounted to the frame adjacent the blade to receive the soil cut by the blade. The wheels are pivotally mounted to the frame for movement of the wheels about the back wall and floor of the bucket between a first position and a second position. When the wheels are in the second position, a portion of each of the wheels underlies a portion of the floor of the bucket bringing the wheels closer to the center of gravity of the apparatus and its load.

12 Claims, 5 Drawing Sheets

EARTH MOVING SCRAPER

BACKGROUND OF THE INVENTION

1. Field of the Invention

The present invention relates to an apparatus for modifying the earth's surface by removing soil from the earth's surface at one location, moving the soil to a new location to fill low areas. In particular this invention relates to earth moving scrapers that are of the type having a frame carried by at least two wheels, a tongue mounted to the frame for attachment to a tractor, a cutting blade connected to the frame, and a bucket pivotally mounted to the frame adjoining the blade so that the bucket receives the soil cut by the blade.

2. Description of the Prior Art

Scrapers and earth moving apparatus of the general type to which the present invention relates are well-known in the art. A typical scraper disclosed in the art comprises a frame having a front end, to which is attached a tongue for pulling the scraper, two opposing sides, and at least two wheels pivotally connected to the opposing sides. A bucket for holding earth is pivotally mounted to the frame. The bucket has a floor, an upstanding rear wall, two upstanding opposed side walls, an open front and an open top. A blade is attached to the front edge of the floor of the bucket for cutting the earth to a predetermined depth as the apparatus is moved forward over the earth's surface. The soil cut from the earth by the blade is collected in the bucket. When the bucket is full of soil, the scraper is transported to another location where the soil is deposited.

In order to complete the three tasks, cutting, transporting and filling, the cutting blade and the bucket must be positioned at different heights above the ground surface. To accomplish this the wheels are pivotally attached to the frame so that the rear portion of the sides of the frame may be raised and lowered in relation to the wheels. The center of the arc of the pivot is established so that the wheels move generally vertically in relation to the bucket, keeping the rear wall of the bucket laterally spaced apart and in front of the wheels. When the scraper is cutting the soil, the frame is lowered to its generally lowest position. Of course, cuts of different depths may be made, depending upon the hardness of the soil and the final grade to be reached, which require generally small variations in the height of the cutting blade and frame. When the bucket is full of soil the frame is raised to its second, or transport, position where maximum clearance is maintained between the cutting edge of the blade and the earth's surface. The wheels remain laterally spaced apart from the bucket and to the rear of the rear wall of the bucket. When the soil is to be distributed for the fill operation, the frame is lowered close to the first position but with the blade above the ground a predetermined distance. For those scrapers that have a blade fixed to the frame, the blade will act as a grader, spreading and leveling the soil to a predetermined thickness as the soil is released from the bucket.

Scrapers are classified by the amount of soil that they can carry measured in cubic yards. Tractors are manufactured to handle predetermined sized loads with a large number of existing tractors capable of handling at the maximum, 17 cubic yards.

In most cases, the larger the amount of earth moved during the transport task, the more efficient the scrapers will be. Scrapers manufactured under the prior art designs that are sized to carry more than 18 cubic yards of soil are too large to be handled by the typical tractor. Notwithstanding the existence of such prior art scrapers, it remains clear that there is a need for scrapers capable of carrying more than 18 cubic yards of soil that can still be hauled by the popular sized existing tractors.

SUMMARY OF THE INVENTION

The present invention relates to an apparatus for removing soil from the earth's surface, moving the soil to a new location and unloading in areas at that new location. Most simply stated, the apparatus of this invention comprises a frame having two opposing longitudinally extending sides, each having first ends that are connected to one another by a front end of the frame extending therebetween. The second ends of each side frame are pivotally connected to at least two wheels for engagement with the ground. A cutting blade is laterally disposed between the opposed longitudinal sides of the frame adjacent to the bottom of the frame. A bucket having a floor, an upstanding back wall, two upstanding side walls, an open front and an open top, is pivotally mounted to the frame adjacent the blade.

A carrier is pivotally attached to the frame and is connected to the wheels for moving and positioning the wheels about the back wall and floor of the bucket between a first position and a second position. When the wheels are in the second position, a portion of each of the wheels underlies a portion of the floor of the bucket.

The first end of a tongue is mounted to the front end of the frame so that the second end of the tongue extends outwardly therefrom. The second end of the tongue has a connecting means attached thereto, which is attachable to a tractor for movement of the apparatus by the tractor.

The invention accordingly comprises an article of manufacturer possessing the features, properties, and the relation of elements which will be exemplified in the article hereinafter described, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings, in which.

Similar reference characters refer to similar parts throughout the several views of the drawings.

DESCRIPTION OF THE PREFERRED EMBODIMENT

Figure 1:
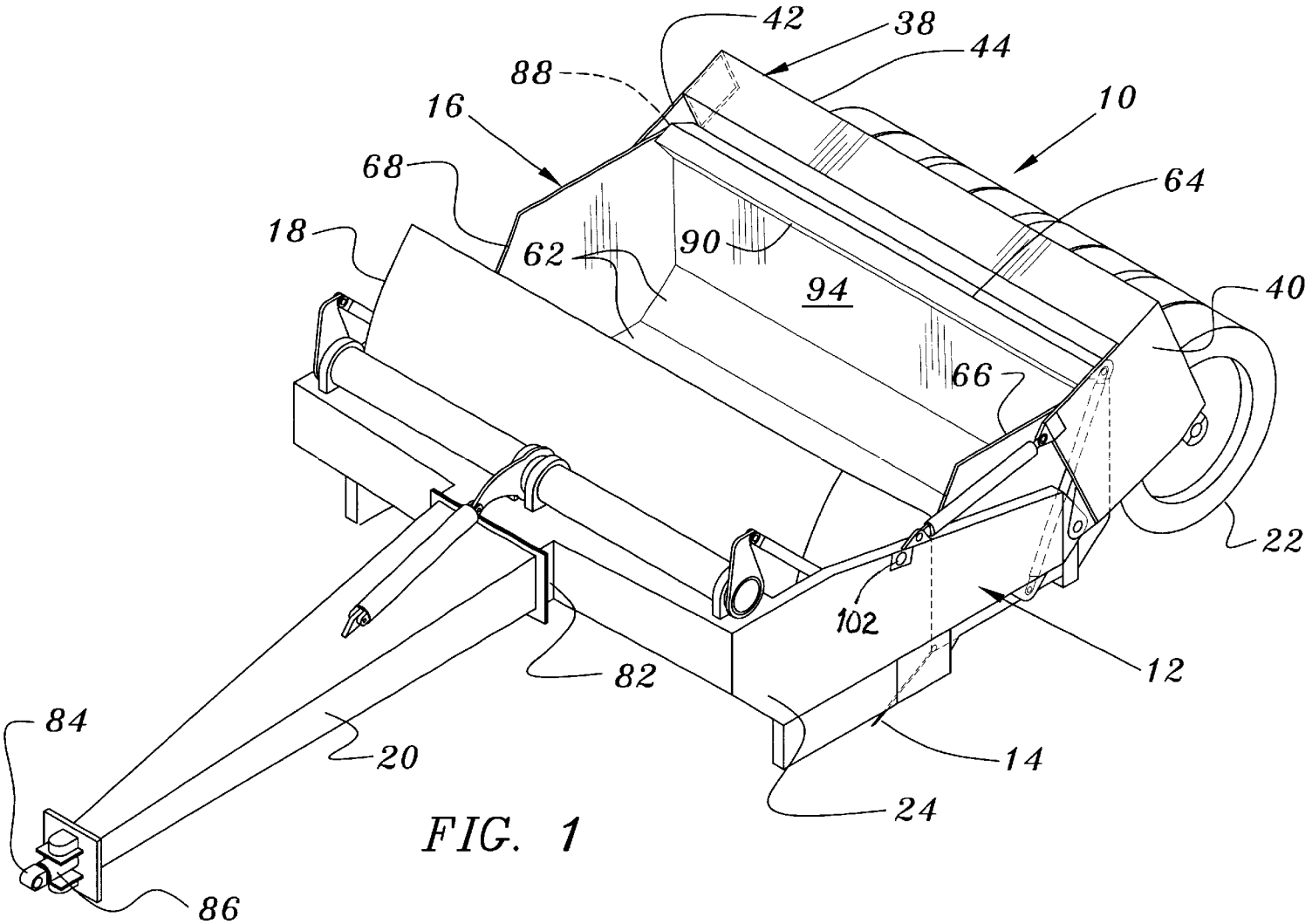
FIG. 1 is an isometric view of the earth moving apparatus of this invention.

A preferred embodiment for the earth moving apparatus of this invention is illustrated in the drawing FIGS. 1–2 and 4–8 in which the apparatus is generally indicated as 10. Referring first to the view of FIG. 1, it can be seen that the apparatus 10 comprises a frame 12, a cutting blade 14, a bucket 16, an apron 18, a tongue 20, and at least two ground engaging wheels 22.

Figure 4:
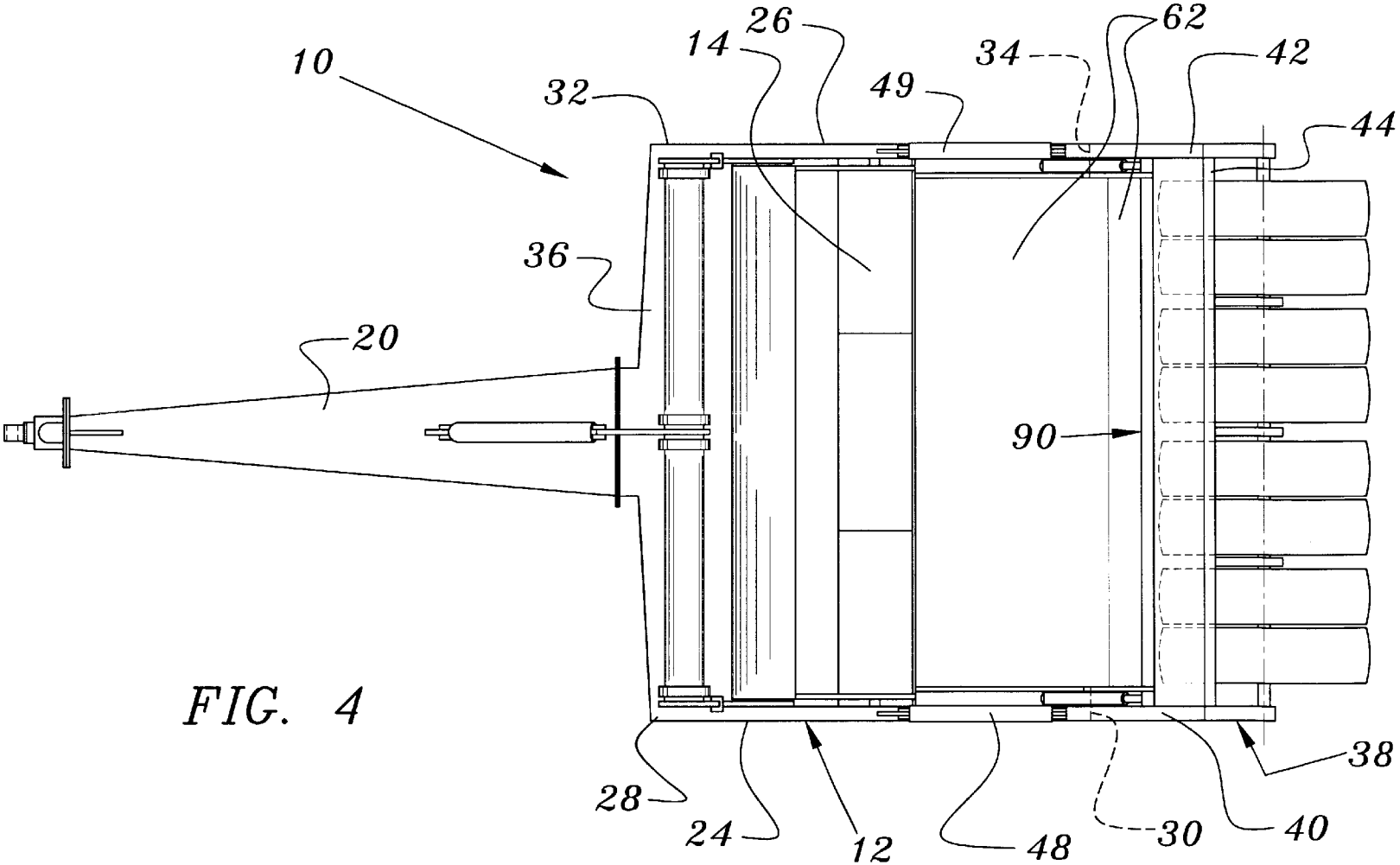
FIG. 4 is a top plan view of the apparatus of FIG. 1.

The frame 12 is comprised of first and second opposing longitudinal side members 24 and 26 respectively, which are more clearly seen in FIG. 4. The first side member 24 has a first end 28 and a second end 30 and the second side member 26 has a first end 32 and a second end 34. The first end 28 of side member 24 and the first end 32 of side member 26 are joined to one another by a front member 36. The second ends 30 and 34 of side members 24 and 26 respectively, are attached to a carrier, shown generally as 38.

Figure 2:
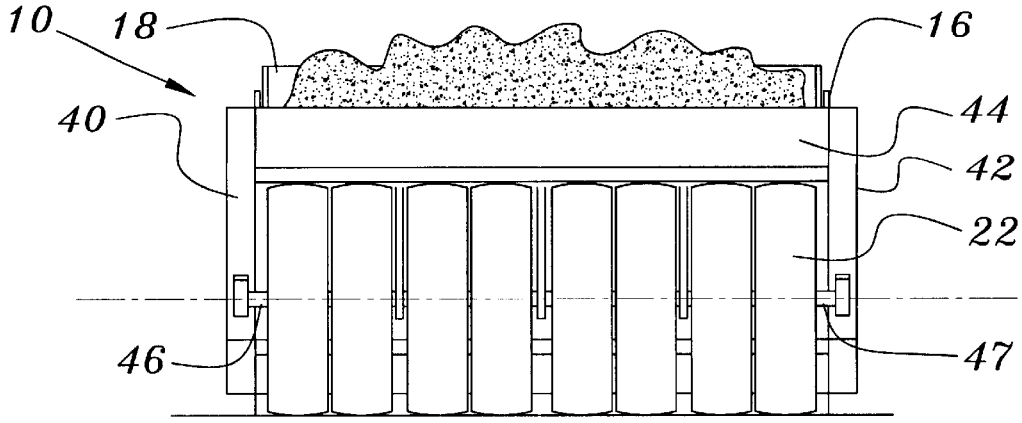
FIG. 2 is a rear view of the apparatus of FIG. 1.
Figure 3:
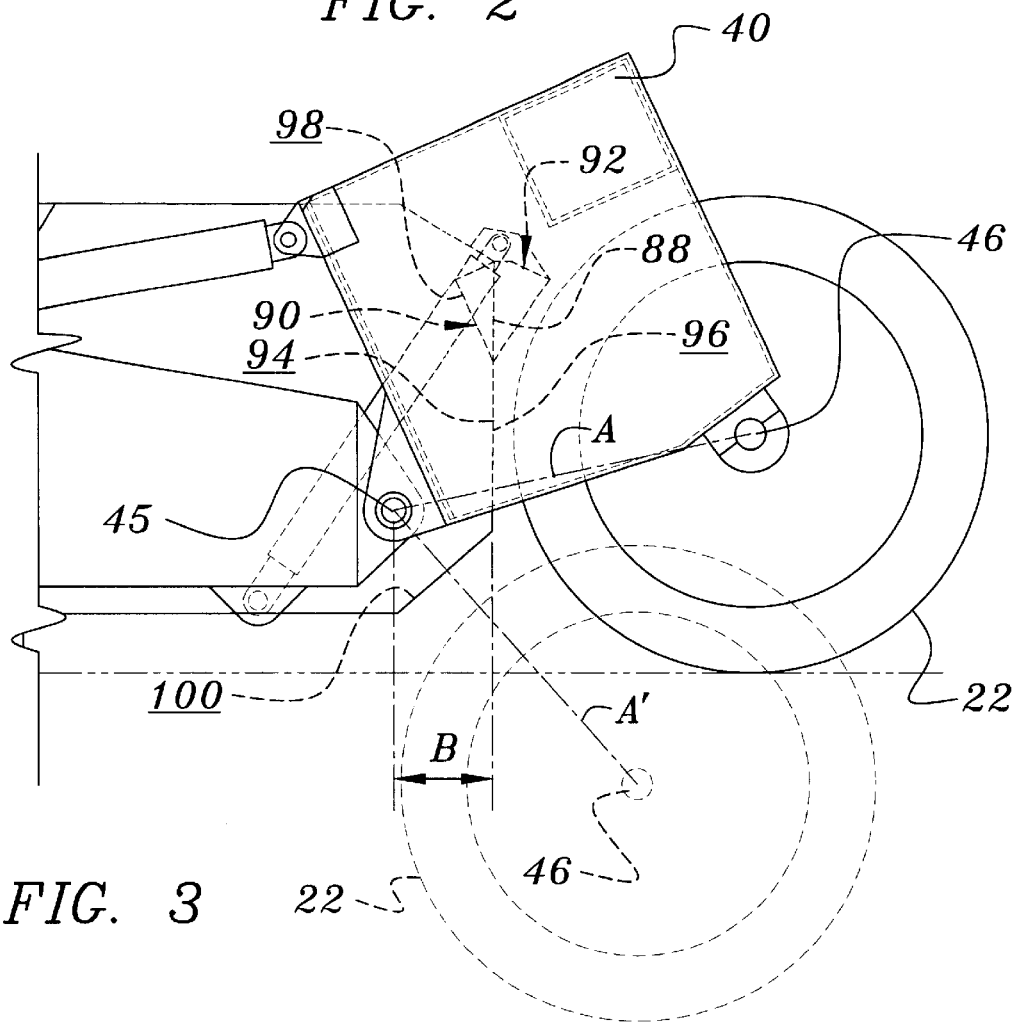
FIG. 3 is a detailed side elevational view of the rear portion of the apparatus of FIG. 1, illustrating the first position and the second position of the wheels (shown in phantom)

As seen in FIG. 1 and FIG. 4, the carrier 38 comprises a first arm 40, a second arm 42 and a beam 44 that has one end attached to the first arm 40 and the other end attached to the second arm 42. In a preferred embodiment, the arms are generally rectangular plates with reinforcing to provide the necessary strength. In other embodiments the arms 40 and 42 may be constructed in other ways, including but not limited to, trusses constructed of tubes to which are attached the wheel axles, the connection with the frame and a point for attaching an actuator for movement of the arms. The beam 44 provides increased strength to the back end of the apparatus 10 as well as support to the wheel axles. The first arm 40 is pivotally attached to the second end 30 of the first side member 24 at pivot point 45. The wheels 22 are mounted in pairs upon four separate axles. As seen in FIG. 2 and FIG. 3 the first axle is identified as 46 and is attached to the first arm 40. The other three axles are held by supports that project downwardly between the tire pairs. The axle distal the first axle is designated as axle 47, and one end of axle 47 is mounted to the second arm 42.

Figure 5:
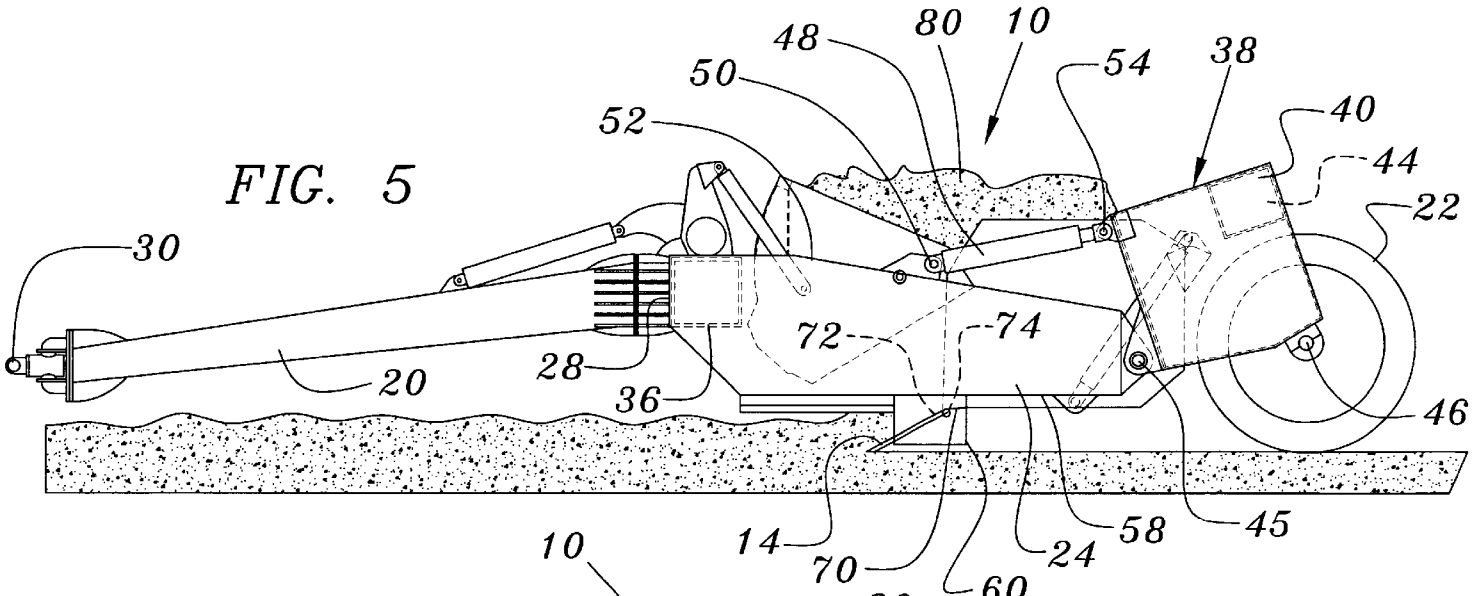
FIG. 5 is a right side elevational view of the apparatus of FIG. 1, illustrating the apparatus in the cutting position and illustrating soil being removed from the earth's surface.
Figure 6:
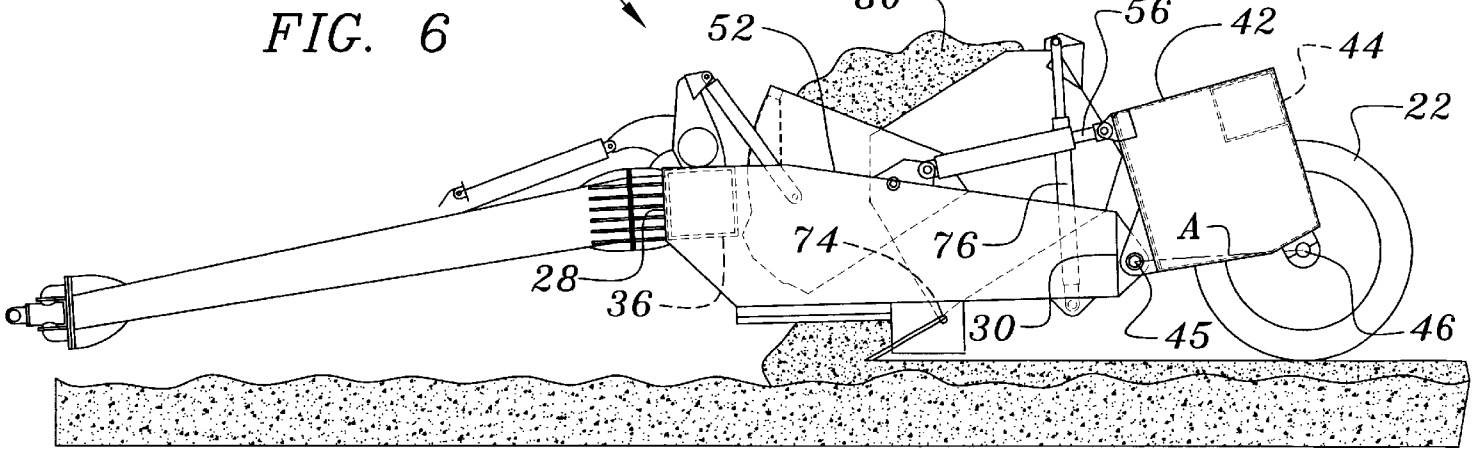
FIG. 6 is a right side elevational view of apparatus of FIG. 1, illustrating the apparatus in the fill position, illustrating soil being deposited on the earth's surface.

As seen in FIG. 5, an actuator, conveniently a double-acting hydraulic cylinder 48, has a first end 50 that is attached to the top edge 52 of the first side member 24 and a second end 54 that is pivotally attached to the arm 40. When the piston rod 56 of the double acting cylinder 48 is extended, as seen in FIG. 6, the axle 46 is pivoted about the pivot point 45. The line A that extends from the pivot point 45 to the axle 46, comprises the pivot radius of the axle 46. The attachments and the operation of the second arm 42 is identical to the attachments and the operation of the first arm 40, as it is a mirror image thereof. The second arm 42 is pivotally mounted to the second end 34 of the second side member 26 at a pivot point (not shown). The arm 42 is attached to the axle 47 for movement of the axles of the wheels 22 at the distance of radius A from the pivot point (not shown). The double-acting hydraulic cylinder 49 operates in the same manner as the hydraulic cylinder 48, providing the power to pivot the second arm 42. The location of the pivot point 45 and the pivot point on the opposing side (not shown) are critical as the pivot points must be positioned sufficiently high on each of the respective side members 24 and 26 so that the arc subtended by the axles moves about the end wall 64 of the bucket 16 and under the floor 62 of the bucket 16. The pivot points must also be positioned and the radius selected so that the wheels are close to the bucket in the first and second positions.

The cutting blade 14 is connected to the frame 12 and is disposed generally laterally between the opposing side members 24 and 26 of the frame 12 adjoining the bottom 58 of side member 24 and the bottom (not shown) of side member 26. In a preferred embodiment, the blade 14 is fixedly mounted to the portion 60 of the frame 12 that extends downwardly from the side member 24 and a portion (not shown) of the frame 12 that extends downwardly from the side member 26. In other embodiments, the blade 14 may be attached to the bucket 16.

The bucket 16 comprises a floor 62, an upstanding back wall 64 and upstanding side walls 66 and 68. The forward edge 70 of the floor 62, as seen in FIG. 5, is adjoining the trailing edge 70 of the blade 14. In a preferred embodiment, the bucket is attached by a hinge 74 to the trailing edge 72 of the blade 14. In a preferred embodiment, the blade is fixed to the frame 12 so the bucket 16 pivots on the hinge 74. In other embodiments, the bucket 16 is pivotally mounted to the frame 12 and the blade is fixedly attached to the bucket 16. A double-acting hydraulic cylinder 76 has one end mounted to the frame 12 and the other end mounted to the bucket. Upon extending the piston rod 78, as seen in FIG. 6, the bucket 16 rotates about the hinge 74.

Figure 7:
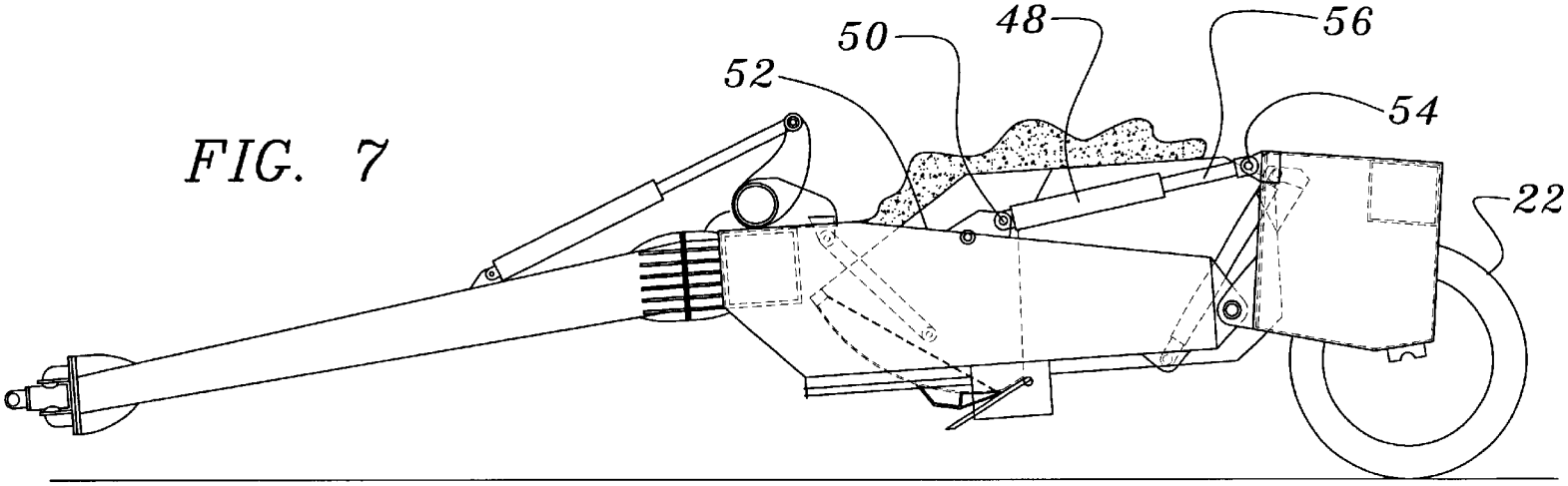
FIG. 7 is a right side elevational view of the apparatus of FIG. 1, illustrating the apparatus being moved toward said transport position.

As seen in FIGS. 5–8, when the piston rod 56 of hydraulic cylinder 48 and the piston rod (not shown) of hydraulic cylinder 49 is extended, the wheels 22 rotate about pivot point 45, and the opposing pivot point (not shown) moving between a first position and a second position. When the piston rods are retracted the wheels pivot between the second position and the first position . As shown in FIG. 3 and 5, the first position is generally the lowest position of the blade 14 in relation to the surface of the earth 80 so it can cut the ground. The second position is the highest position of the blade in relation to the surface of the earth 80 and is generally used for transporting the apparatus 10 from one place to another. As seen in FIG. 7 the wheels 22 are being moved toward the second position and in FIG. 8 the wheels have now been moved to the second position. As shown in FIG. 3 in phantom, and in FIG. 8, when the wheels 22 are in the second position, a portion of each of the wheels 22 underlies a portion of the floor 62 of the bucket 16. In a preferred embodiment, as seen in FIG. 3, a space B is formed in the floor 62 of the bucket 16 to receive a portion of the wheels 22 when the wheels are in their second position.

The tongue 20 has a first end 82 that is attached to the frame 12 and it has a second end 84 that extends outwardly therefrom. A portion of the second end comprises an attaching means, conveniently hitch 86 which is configured for attachment to a tractor (not shown) for pulling the apparatus 10. Hitches 86 are well-known in the art; however, hitches that are rotatable or pivotable about the three major axes, and combinations thereof, are preferred for use with the apparatus 10 to accommodate for turning the tractor, movement of the wheels of the apparatus 10 between the first position and the second position and lateral tilting of the apparatus 10 in relation to the tractor as it moves over rough terrain. In a preferred embodiment the tongue 20 extends outwardly from the frame (measured in a horizontal plane) 380 cm. (148 inches). In other preferred embodiments, the tongue 20 extends outwardly from the frame (measured in a horizontal plane) at least 307 cm (120 inches). The second end 84 of the tongue 20 is mounted to the front member 36 of the frame 12 so that laterally it is at right angles to the member 36. However, in a preferred embodiment, the tongue 20 is angled downwardly from the front member 36 at approximately 6–10 degrees so the frame 12 can be higher from the ground.

The upper portion 88 of the back wall 64 of the bucket 16 is strengthened by a first reinforcement bar 90 and a second reinforcement bar 92. As seen in FIG. 1 and FIG. 3 the first reinforcement bar 90 is attached to the interior surface 94 of the upper portion 88 of the back wall 64. The second reinforcement bar 92 is attached to the outside surface 96 of the upper portion 88 of the back wall 64. The two reinforcement bars are triangular in shape having a long side, a short side and a side that has a length that is intermediate in length to the lengths of the long and short sides. The longer side of the first reinforcement bar 90 is attached to the interior surface of the bucket so that the second longest side faces downwardly. The longer side of the second reinforcement bar 92 is attached to the bucket and the second longest side faces downwardly.

As seen in FIG. 3,the reinforcement bar 92 is shaped and sized so that it does not conflict with the wheels 22 while the wheels 22 are in the first position, permitting the wheels 22 to be as close as possible to the exterior of the back wall 64 of the bucket 16 and to the center of gravity of the apparatus 10. In addition, the second reinforcement bar 92 has a downwardly facing surface 98 that works in conjunction with the upwardly facing surface 100 to direct the soil as it is received within the bucket during the cutting operation. The two surfaces 98 and 100 provide a curved back wall 64 that directs the soil upward and inward over upon itself as it is received into the bucket helping to prevent blockages during the cutting operation and keeping the soil within the bucket.

The operation of the apparatus 10, whether cutting/planing soil from the terrain and collecting it in the bucket, moving the soil to new location or distributing it as fill at that new location, is well-known. Tractors are sized to haul loads of predetermined size and weight. There are many tractors that are marketed and that are in use for numerous tasks that are rated in the range of 350 to 400 horsepower. For effective use for hauling scrapers these tractors will weight in the range of 43,000 to 45,000 pounds. Insufficient horsepower will result in the failure to pull scrapers and insufficient weight will result in the tractor's losing traction. These tractors are typically used to haul scrapers that are rated at a capacity of 17–18 cubic yards of soil. Generally, the greater the capacity of the scraper the more efficient the cut, haul and fill operations.

Until the current design, there were few if any towed scrapers capable of carrying more than 18 cubic yards of soil as the popular 350 to 400 horsepower tractors can not haul larger scrapers constructed in accordance with the prior art design. The current apparatus 10 has a capacity of 24 cubic yards and is capable of being hauled by a 350 to 400 horsepower tractor. However this is but one embodiment, as there are many sizes /models of the apparatus 10 that can be made using the disclosed concepts. For instance, the apparatus 10 can be sized and configured to hold any size of load up to at least 24 cubic yards. The prior art designs place too much load on the tractor hitch as the center of gravity of the scraper plus its load is too far forward. In a preferred embodiment of the apparatus 10, prior to using the apparatus 10 for transport, the wheels 22 are pivoted about the pivot point 45 to the second position, as seen in FIG. 3, which brings them closer to the center of gravity of the combined weight of the scraper and its load. By being closer to the center of gravity, the wheels 22 will receive more of the weight and reduce the weight placed on the first end 30 of the tongue 20 and thus reduce the downward force on the tractor hitch. In the second position, a portion of the wheels 22 underlie a portion of the floor 62 and are received within the space B that is formed in the floor 62 of the bucket 16 to receive the wheels 22.

When the apparatus 10 is being used to cut soil from the earth's surface, the wheels 22 are in the first position as seen in FIG. 3 and in FIG. 5. It is important that the wheels 22 remain close to the back wall 64 of the bucket 16 so that as much of the weight of the apparatus 10 and its load as is possible is carried by the wheels 22 during the cutting operation. The radius A could be extended so that when the wheels are moved to the second position they would be further forward, however this would be detrimental to the load carrying capacity of the apparatus 10 during the cutting operation.

Figure 8:
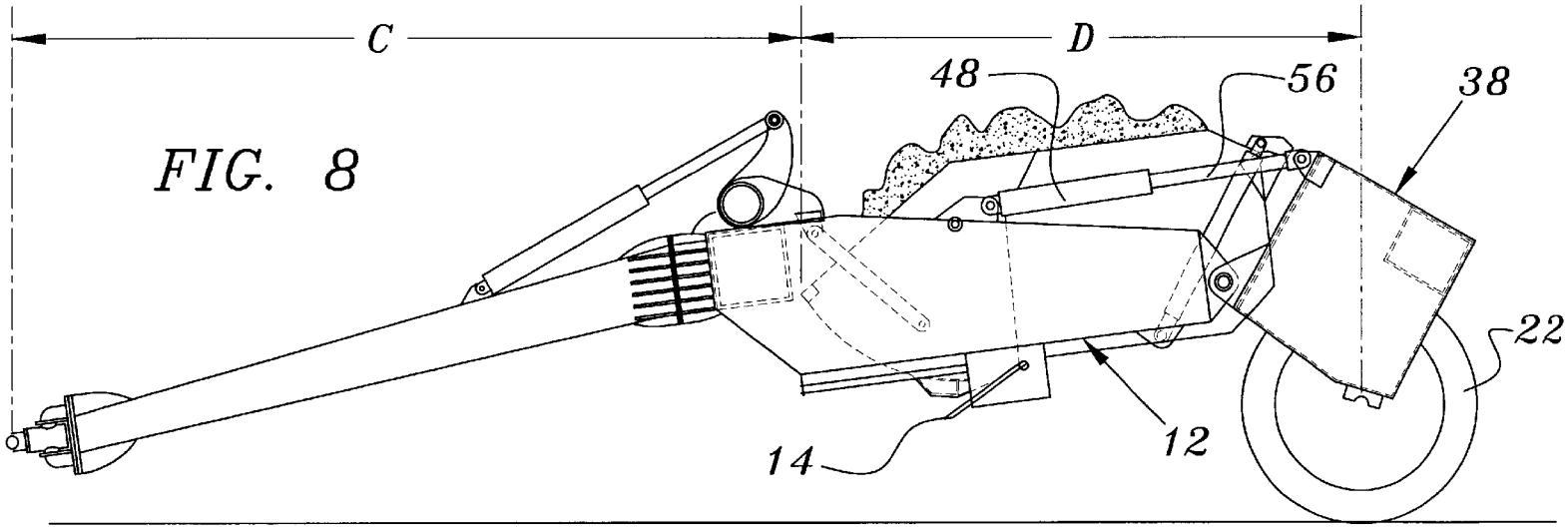
FIG. 8 is a right side elevational view of the apparatus of FIG. 1, in the full transport position.

The length of the tongue 20 is extended so that it is longer than 307 cm. (120 inches) in length to provide a further reduction of the downward force on the tractor's hitch. As seen in FIG. 1 the apron 18 is pivotally mounted to the frame at pivot point 102 and a corresponding pivot (not shown) on the opposing side of the apron 18, for rotation between a first position, the fully open position, and a second position, the closed position. The apron is moved between the first and second positions by a well known means, that includes a double-acting hydraulic cylinder and a system of levers. As seen in FIG. 8, the apparatus 10 is sized and configured so that when the apron is in the second position and the wheels 22 are in the second position, the ratio of the distance C, from the second end of the tongue to the forward most portion of the apron, to the distance D, from the forward most portion of the apron to the axes of the wheels 22, is at least 1.1. In a preferred embodiment, this ratio is 1.5. As seen in FIG. 8, the distances C and D are measured in a horizontal plane.

The apparatus 10 is constructed from steel and other well-known materials. All the double-acting hydraulic cylinders 48, 49, 76 and those that are not numbered are connected to the hydraulic system of the tractor and are operated by standard and well-known controls. To achieve the movements necessary to pivot the wheels between the first position and the second position requires hydraulic cylinders 48 and 49 that are larger so they have a longer piston rod to attain the full movement of the wheels to the second position. Those skilled in the art will be able to determine the appropriate size needed for the particular size apparatus 10.

Having thus set forth a preferred construction for the current invention, is to be remembered that this is but a preferred embodiment. The use and method of operation of the apparatus 10 is well known in the art and no further explanation of the use or method of operation need be discussed.

While the foregoing describes a particularly preferred embodiment of the present invention, it is to be understood that numerous variations and modifications of the structure will occur to those skilled in the art. Accordingly, the foregoing description is to be considered illustrative only of the principles of this invention and is not to be considered limitative thereof, the scope of the invention being determined solely by the claims appended hereto.

What is claimed is:

1. An earth moving and ground leveling apparatus comprising:

a frame having opposing longitudinal sides, each side having a first and second end and a bottom;

a cutting blade connected to said frame, said blade being disposed generally laterally between said opposing longitudinal sides of said frame adjacent to said bottom of said frame;

a bucket having a floor, an upstanding back wall, and a pair of upstanding side walls, said bucket being disposed with the forward edge of said floor thereof adjoining the trailing edge of said blade;

a carrier pivotally mounted to said frame;

at least two ground engaging wheels being connected to said carrier for movement of said wheels between a first position and a second position, said wheels pivoting about said back wall and said floor of said bucket such that when said wheels are in said second position, a portion of each of said at least two ground engaging wheels underlies a portion of said floor of said bucket;

an actuator having a first end mounted to said frame and a second end attached to said carrier for movement of said wheels between said first and second positions;

a tongue having a first end attached to said frame and said second end extending outwardly therefrom; and attaching means connected to said second end of said tongue, whereby said tongue is connectable to a tractor.

2. An apparatus as in claim 1, wherein a space is formed in said floor of said bucket into which a portion of said wheels enter when said positioning means pivots said wheels toward said second position.

3. An apparatus as in claim 1, wherein said tongue extends outwardly from said frame at least 307 cm. (120 inches).

4. An apparatus as in claim 1, wherein said bucket further comprises an open front end, said apparatus further comprising an apron pivotally mounted to said frame for movement between a first and a second position such that when said apron is in said second position at least a portion of said open front end of said bucket is closed by said apron, said apparatus being sized and configured such that when said apron is in said second position and said wheels are in said second position the ratio of the distance from said second end of said tongue to said forward-most portion of said apron to the distance from the forward-most portion of said apron to said axis of said wheels is greater than 1.1, all dimensions being measured in a horizontal plane.

5. An apparatus as in claim 1, wherein said bucket further comprises an interior surface, an upper portion and a first reinforcement bar extending laterally across said interior surface of said upper portion of said back wall, said reinforcement bar being generally triangular in shape having a long side, a short side and a side of length that is intermediate to that of said short side and said long side, said long side of reinforcement bar being attached to said bucket so that said intermediate length side faces downwardly toward said floor of said bucket, such that soil entering said bucket during cutting operations is pushed against said reinforcement bar and is turned back into said bucket.

6. An apparatus as in claim 1, wherein said bucket further comprises an exterior surface, an upper portion and a second reinforcement bar extending laterally across said exterior surface of said upper portion of said back wall, said reinforcement bar being generally triangular in shape having a long side, a short side and a side having a length that is intermediate to that of said short side and said long side, said long side of said reinforcement bar being attached to said bucket so that said intermediate length side faces downwardly such that when said wheels are in said first position a portion of said wheels underlies said second reinforcement bar.

7. An earth moving and ground leveling apparatus comprising:

a frame having opposing longitudinal sides, each having a first and second end;

a cutting blade connected to said frame and being disposed generally laterally between said opposing longitudinal sides of said frame adjacent to the bottom of said frame and;

a bucket having a floor and upstanding back and side walls and an open front end, said bucket being disposed with the forward edge of said floor thereof adjacent to the trailing edge of said blade;

a carrier pivotally mounted to said frame;

at least two ground engaging wheels being connected to said carrier for movement of said wheels between a first position and a second position;

an actuator having a first end mounted to said frame and a second end attached to said carrier for movement of said wheels between said first and second positions;

a tongue having a first end attached to said frame and said second end extending outwardly therefrom;

attaching means connected to said second end of said tongue, whereby said tongue is connectable to a tractor; and an apron pivotally mounted to said frame for movement between a first and a second position such that when said apron is in said second position at least a portion of said open front end of said bucket is closed by said apron, said apparatus being sized and configured such that when said apron is in said second position and said wheels are in said second position the ratio of the distance from said second end of said tongue to said forward most portion of said apron to the distance from the forward most portion of said apron to said axis of said wheels is greater than 1.1, all dimensions being measured in a horizontal plane.

8. An earth moving and ground leveling apparatus comprising:

a frame having opposing longitudinal sides, each side having a first and second end and a bottom;

a cutting blade connected to said frame, said blade being disposed generally laterally between said opposing longitudinal sides of said frame adjacent to said bottom of said frame;

a bucket having a floor, an upstanding back wall, and a pair of upstanding side walls, and an open front end, said bucket being disposed with the forward edge of said floor thereof adjoining the trailing edge of said blade;

a carrier pivotally mounted to said frame;

at least two ground engaging wheels being connected to said carrier for movement of said wheels between a first position and a second position, said wheels pivoting about said back wall and said floor of said bucket such that when said wheels are in said second position, a portion of each of said wheels underlies a portion of said floor of said bucket;

an actuator having a first end mounted to said frame and a second end attached to said carrier for movement of said wheels between said first and second positions;

a tongue having a first end attached to said frame and said second end extending outwardly therefrom;

an apron pivotally mounted to said frame for movement between a first and a second position such that when said apron is in said second position at least a portion of said open front end of said bucket is closed by said apron, said apparatus being sized and configured such that when said apron is in said second position and said wheels are in said second position the ratio of the distance from said second end of said tongue to said forward-most portion of said apron to the distance from the forward-most portion of said apron to said axis of said wheels is greater than 1.1, all dimensions being measured in a horizontal plane; and attaching means connected to said second end of said tongue, whereby said tongue is connectable to a tractor.

9. An apparatus as in claim 8, wherein said bucket further comprises an interior surface, an upper portion and a first reinforcement bar extending laterally across said interior surface of said upper portion of said back wall, said reinforcement bar being generally triangular in shape having a long side, a short side and a side of length that is intermediate to that of said short side and said long side, said long side of reinforcement bar being attached to said bucket so that said intermediate length side faces downwardly toward said floor of said bucket, such that soil entering said bucket during cutting operations is pushed against said reinforcement bar and is turned back into said bucket.

10. An apparatus as in claim 8, wherein said bucket further comprises an exterior surface, an upper portion and a second reinforcement bar extending laterally across said exterior surface of said upper portion of said back wall, said reinforcement bar being generally triangular in shape having a long side, a short side and a side having a length that is intermediate to that of said short side and said long side, said long side of said reinforcement bar being attached to said bucket so that said intermediate length side faces downwardly such that when said wheels are in said first position a portion of said wheels underlies said second reinforcement bar.

11. An earth moving and ground leveling apparatus comprising:

a frame having opposing longitudinal sides, each side having a first and second end and a bottom;

a cutting blade connected to said frame, said blade being disposed generally laterally between said opposing longitudinal sides of said frame adjacent to said bottom of said frame;

a bucket having a floor, a pair of upstanding side walls, and an upstanding back wall, said bucket being disposed with the forward edge of said floor thereof adjoining the trailing edge of said blade; said upstanding back wall having an interior surface, and said interior surface having an upper portion;

a first reinforcement bar extending laterally across said interior surface of said upper portion of said back wall, said reinforcement bar being generally triangular in shape having a long side, a short side and a side of length that is intermediate to that of said short side and said long side, said long side of reinforcement bar being attached to said bucket so that said intermediate length side faces downwardly toward said floor of said bucket, such that soil entering said bucket during cutting operations is pushed against said reinforcement bar and is turned back into said bucket, a carrier pivotally mounted to said frame;

at least two ground engaging wheels being connected to said carrier for movement of said wheels between a first position and a second position;

an actuator having a first end mounted to said frame and a second end attached to said carrier for movement of said wheels between said first and second positions;

a tongue having a first end attached to said frame and said second end extending outwardly therefrom; and attaching means connected to said second end of said tongue, whereby said tongue is connectable to a tractor.

12. An earth moving and ground leveling apparatus comprising:

a frame having opposing longitudinal sides, each side having a first and second end and a bottom;

a cutting blade connected to said frame, said blade being disposed generally laterally between said opposing longitudinal sides of said frame adjacent to said bottom of said frame;

a bucket having a floor, an upstanding back wall, and a pair of upstanding side walls, said back wall having an exterior surface, said exterior surface having an upper portion and said bucket being disposed with the forward edge of said floor thereof adjoining the trailing edge of said blade;

a carrier pivotally mounted to said frame;

at least two ground engaging wheels being connected to said carrier for movement of said wheels between a first position and a second position;

an actuator having a first end mounted to said frame and a second end attached to said carrier for movement of said wheels between said first and second positions;

a second reinforcement bar extending laterally across said exterior surface of said upper portion of said back wall, said reinforcement bar being generally triangular in shape having a long side, a short side and a side having a length that is intermediate to that of said short side and said long side, said long side of said reinforcement bar being attached to said bucket so that said intermediate length side faces downwardly such that when said wheels are in said first position a portion of said at least two ground engaging wheels underlies said second reinforcement bar, a tongue having a first end attached to said frame and said second end extending outwardly therefrom; and attaching means connected to said second end of said tongue, whereby said tongue is connectable to a tractor.

* * * * *